US010253562B2

(12) United States Patent
Chou

(10) Patent No.: US 10,253,562 B2
(45) Date of Patent: Apr. 9, 2019

(54) BLIND CO-USED SHEET

(71) Applicant: Tser Wen Chou, Yorba Linda, CA (US)

(72) Inventor: Tser Wen Chou, Yorba Linda, CA (US)

( * ) Notice: Subject to any disclaimer, the term of this patent is extended or adjusted under 35 U.S.C. 154(b) by 153 days.

(21) Appl. No.: 15/401,357

(22) Filed: Jan. 9, 2017

(65) Prior Publication Data

US 2017/0292320 A1 Oct. 12, 2017

(30) Foreign Application Priority Data

Apr. 11, 2016 (TW) ..... 105205008 U

(51) Int. Cl.

| | |
|---|---|
| ***E06B 9/264*** | (2006.01) |
| ***E06B 9/28*** | (2006.01) |
| ***E06B 9/36*** | (2006.01) |
| ***E06B 9/386*** | (2006.01) |
| ***E06B 9/34*** | (2006.01) |
| *E06B 9/24* | (2006.01) |

(52) U.S. Cl.

CPC ..... *E06B 9/264* (2013.01); *E06B 9/28* (2013.01); *E06B 9/34* (2013.01); *E06B 9/36* (2013.01); *E06B 9/367* (2013.01); *E06B 9/386* (2013.01); *E06B 2009/2435* (2013.01)

(58) Field of Classification Search

CPC ..... E06B 9/386; E06B 9/382; E06B 9/264; E06B 9/24; E06B 9/28; E06B 9/34; E06B 9/36; E06B 9/367; E06B 1009/2435; E06B 2009/2423; E06B 2009/2447; E06B 2009/2458; E06B 2009/2405

See application file for complete search history.

(56) References Cited

U.S. PATENT DOCUMENTS

| | | | | |
|---|---|---|---|---|
| 5,638,880 | A * | 6/1997 | Colson | E06B 9/262 156/302 |
| 6,164,363 | A | 12/2000 | Colson et al. | |
| 6,484,786 | B1 * | 11/2002 | Ruggles | E06B 9/262 160/121.1 |
| D497,276 | S * | 10/2004 | Tyner | D6/575 |
| 6,823,923 | B2 * | 11/2004 | Palmer | E06B 9/262 160/84.05 |
| D530,134 | S * | 10/2006 | Smith | D6/580 |
| 7,694,696 | B2 * | 4/2010 | Chang | D03D 1/08 139/383 R |
| 8,079,397 | B2 * | 12/2011 | Robertson | E06B 9/262 160/84.01 |

* cited by examiner

*Primary Examiner* — Beth A Stephan
(74) *Attorney, Agent, or Firm* — Guice Patents PLLC

(57) ABSTRACT

A blind co-used sheet includes a vertical first blind sheet, a vertical second blind sheet, transverse double-layered blind sheets sown between the first and second blind sheets and fixing plate assemblies for securely holding front ends of the transverse double-layered blind sheets. The transverse double-layered blind sheets can be turned from a transverse state into a vertical state and used as a vertical blind. Alternatively, the transverse double-layered blind sheets can be 90-degree turned back from the vertical state into the transverse state and used as a Shangri-la blind. Two sides of the transverse double-layered blind sheet have upward and downward extending sunshade sections, which can overlap each other. A sunshade sheet is disposed in the transverse double-layered blind sheet to locate the blind sheets.

5 Claims, 16 Drawing Sheets

BLIND CO-USED SHEET

BACKGROUND OF THE INVENTION

1. Field of the Invention

The present invention relates generally to a blind co-used sheet, and more particularly to a blind co-used sheet, which can enhance the sunshade effect and is convertible between different blind use modes.

2. Description of the Related Art

A conventional vertical blind includes several blind sheets hung on the hanging rod of a slide box. By means of rotating the hanging rod, the blind sheets are changed between a longitudinal state and a transverse state. In the transverse state, the blind sheets are attached to each other so as to interrupt the sunlight from getting into the room. Alternatively, in the longitudinal state, the blind sheets are positioned at intervals, whereby the sunlight can be projected through the gaps between the blind sheets into the room. However, the rotational angle of the hanging rod of the slide box is quite limited. Therefore, when controlling the vertical blind sheets to transversely attach to each other, the rotational angle of the blind sheets is insufficient so that the vertical blind sheets can hardly truly attach to each other to achieve the sunshade effect. Moreover, the blind sheet structures of the vertical blind and the Shangri-la blind are different from each other. Therefore, the blind sheets only have one single function and cannot be applied to both the vertical blind and the Shangri-la blind in common.

SUMMARY OF THE INVENTION

It is therefore a primary object of the present invention to provide a blind co-used sheet. The blind co-used sheet can be secured by different accessories and converted between a vertical blind mode and a Shangri-la blind mode. The fixing direction of the blind sheets can be changed according to a user's requirement. Moreover, in order to enhance the sunshade effect, several sunshade sections with different sunshade areas are disposed on the blind shades. When the blind sheets are controlled by the accessories to shade the sunlight, the sunshade sections will overlap each other to block the gaps between the blind sheets so as to enhance the sunshade effect and achieve a high-performance sunshade blind.

To achieve the above and other objects, the blind co-used sheet of the present invention includes a vertical first blind sheet, a vertical second blind sheet and non-horizontal oblique transverse double-layered blind sheets sown between the first and second blind sheets. Each transverse double-layered blind sheet includes an upper yarn sheet and a lower yarn sheet. Two lateral sides of the upper and lower yarn sheets are sown on the first and second blind sheets. Different areas of sunshade sections upward and downward extend along the sown positions and attach to the first and second blind sheets. After the lateral sides of the upper and lower yarn sheets are sown on the first and second blind sheets, a receiving space is formed between the upper and lower yarn sheets. A sunshade sheet can be placed in the receiving space as necessary. The transverse double-layered blind sheets are sown between the first and second blind sheets in an oblique state so that one end of the transverse double-layered blind sheets is previously raised by a certain height. Accordingly, when rotated, the transverse double-layered blind sheets can be turned to a nearly vertical state.

This minifies the gap between the blind sheets. In addition, the upward and downward extending sunshade sections of two sides of the transverse double-layered blind sheets will overlap each other to block the gaps between the blind sheets and prevent the sunlight from being projected through the gaps into the room. Therefore, the sunshade effect is enhanced. Moreover, the sunshade sheet is placed in the receiving space of the transverse double-layered blind sheets so that the sunlight is further hindered from getting into the room.

Furthermore, in the present invention, the fixing plate assembly is secured to the front end of the transverse double-layered blind sheet. Via the fixing plate assembly, the transverse double-layered blind sheet is hung on the hanging rod of the slide box. The entire set of blind sheets can be 90-degree turned and converted into a vertical blind use mode. Similarly, the upward and downward extending sunshade sections of two sides of the transverse double-layered blind sheets will attach to and overlap each other to block the gaps between the blind sheets and prevent the sunlight from being projected through the gaps into the room. Therefore, the sunshade effect is enhanced.

The present invention can be best understood through the following description and accompanying drawings, wherein:

DETAILED DESCRIPTION OF THE PREFERRED EMBODIMENTS

Figure 1:
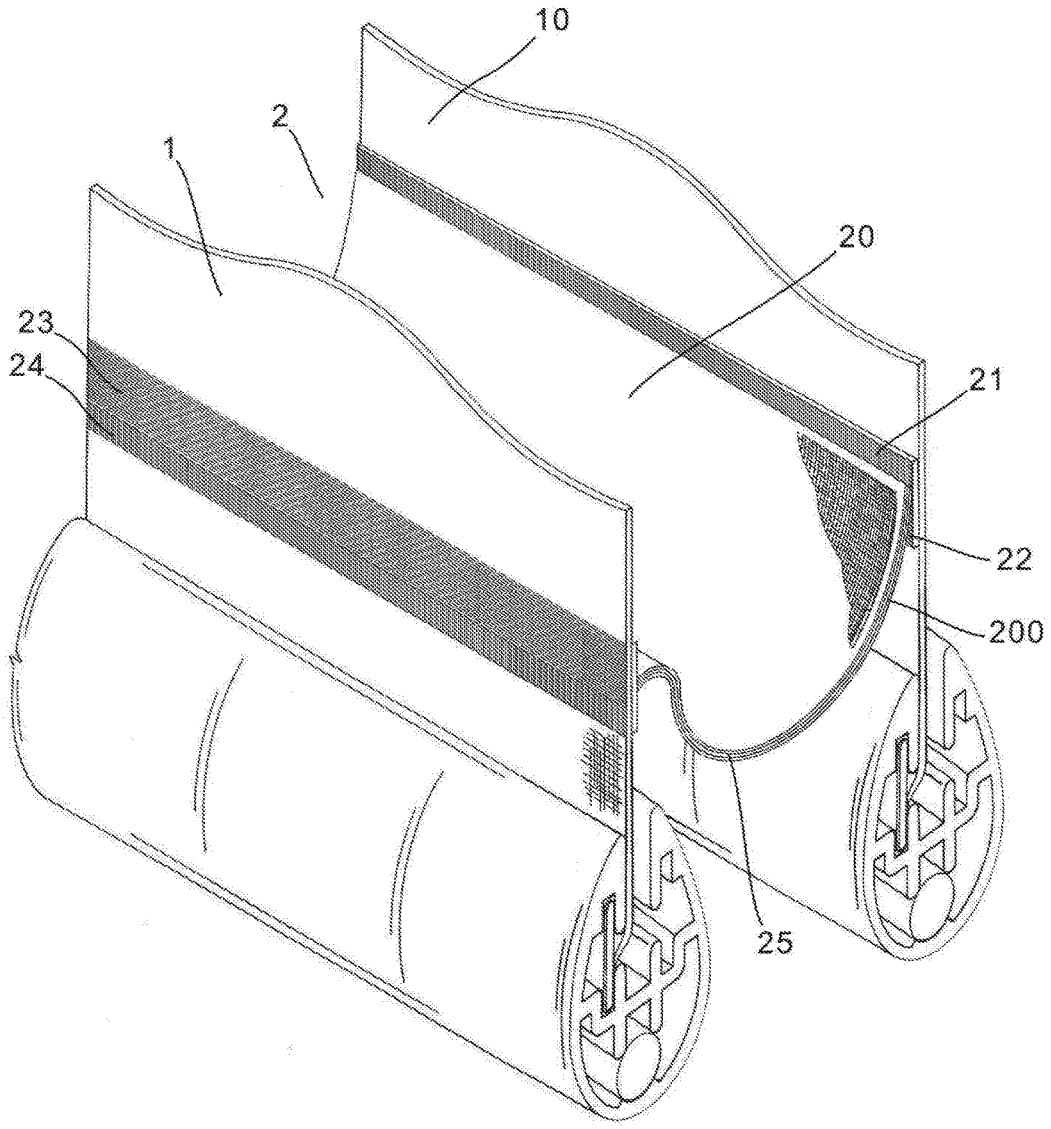
FIG. 1 is a perspective view of the present invention used as a Shangri-la blind.
Figure 2:
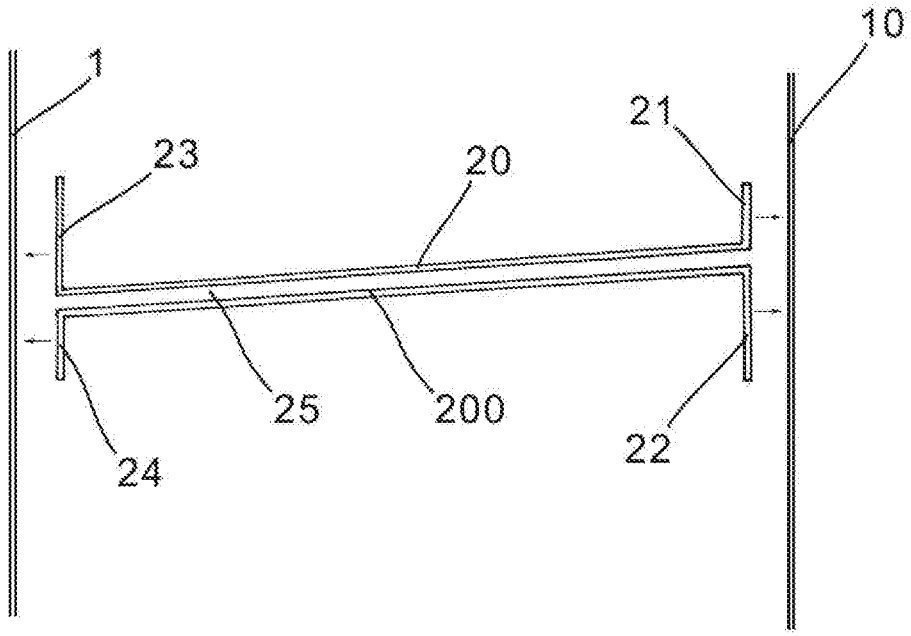
FIG. 2 is a view of the transverse double-layered blind sheet of the present invention, which is to be sown on the blind sheets.
Figure 3:
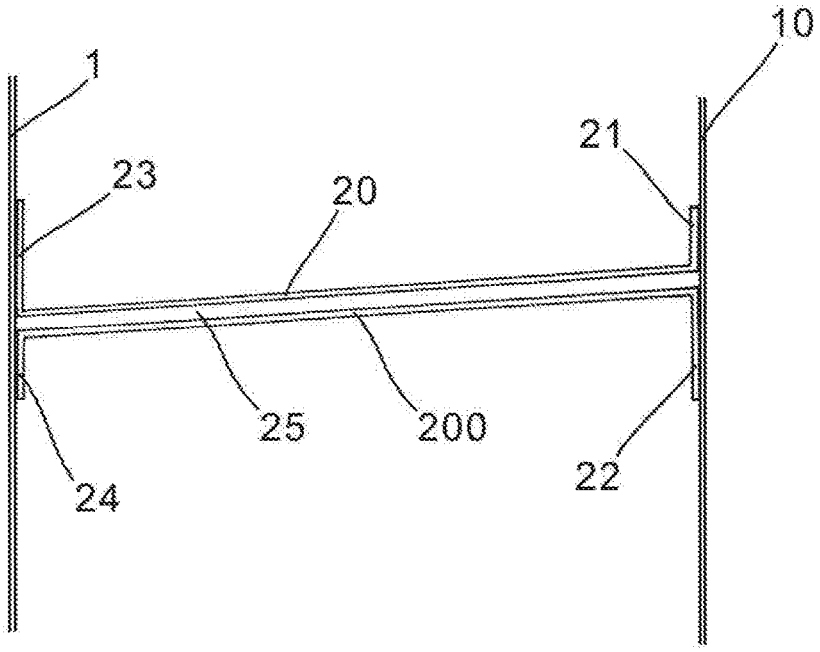
FIG. 3 is a view of the transverse double-layered blind sheet of the present invention, which is sown on the blind sheets.
Figure 4:
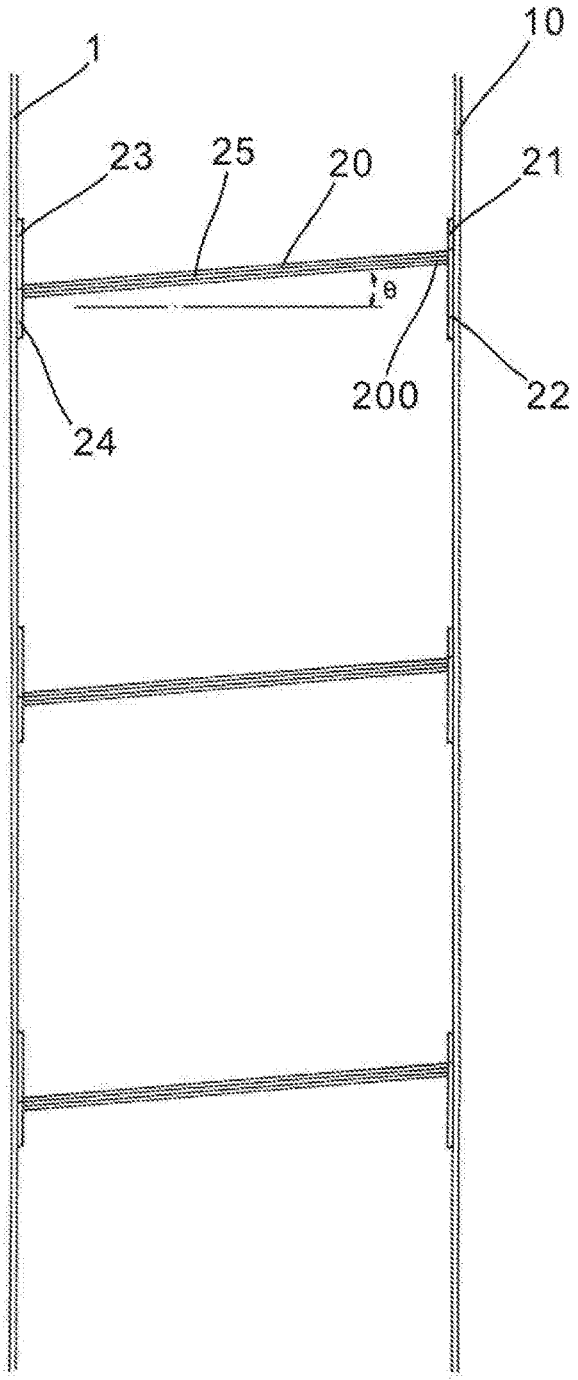
FIG. 4 is a view of the transverse double-layered blind sheet of the present invention, which is sown on the blind sheets in an oblique state.

The blind co-used sheet of the present invention is convertible between two use modes, that is, vertical blind and Shangri-la blind. First, please refer to FIGS. 1 and 2, which show that the present invention is used as a Shangri-la blind. The present invention mainly includes a vertical first blind sheet 1, a vertical second blind sheet 10 and transverse double-layered blind sheets 2 sown between the first and second blind sheets 1, 10. Each transverse double-layered blind sheet 2 is composed of an upper yarn sheet 20 and a lower yarn sheet 200. Two lateral ends of the upper and lower yarn sheets 20, 200 are securely sown on the first and second blind sheets 1, 10 by a specific angle θ. Accordingly, different areas of sunshade sections 21, 22, 23, 24 respectively upward and downward extend along the sown positions and attach to the first and second blind sheets 1, 10. In addition, a receiving space 25 is formed between the upper and lower yarn sheets 20, 200 of the transverse double-layered blind sheet 2 (as shown in FIGS. 3 and 4).

Figure 5:
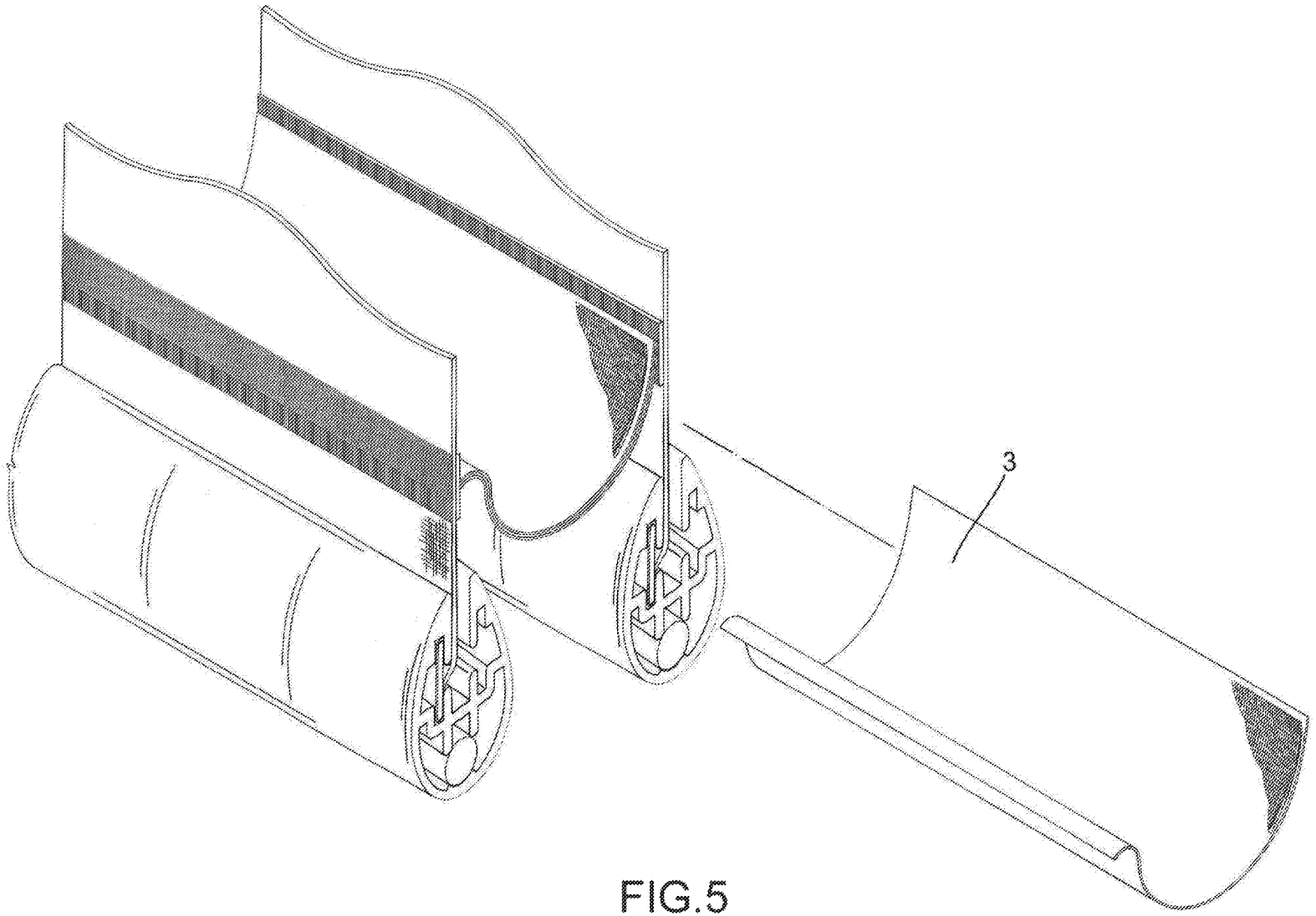
FIG. 5 is a view of the transverse double-layered blind sheet of the present invention, in which a sunshade sheet is placed.
Figure 6:
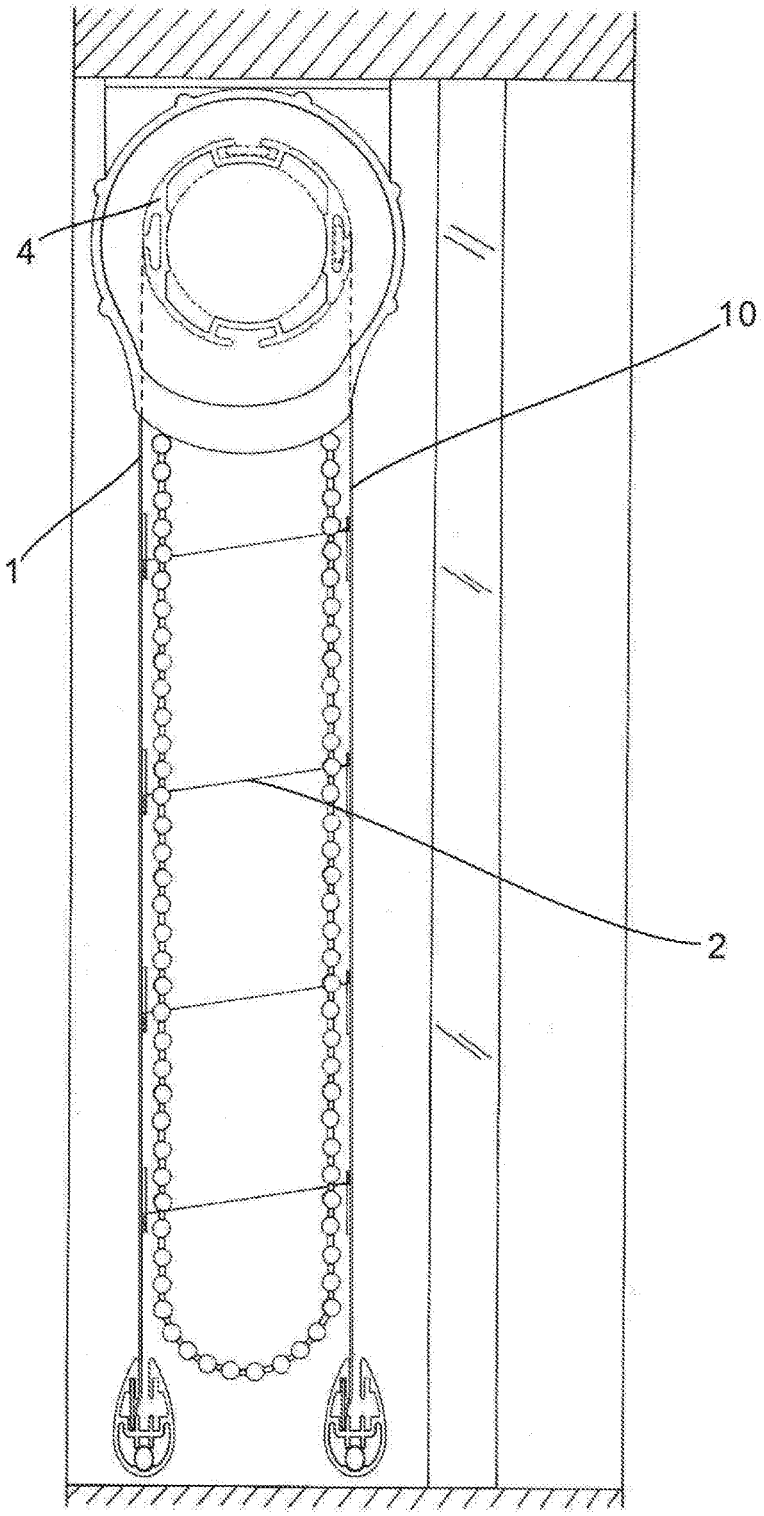
FIG. 6 is a view of the transverse double-layered blind sheet of the present invention, showing the operation thereof.

After sown, the receiving space 25 is formed between the upper and lower yarn sheets 20, 200 of the transverse double-layered blind sheet 2. A nontransparent flexible sunshade sheet 3 (as shown in FIG. 5) can be placed in the receiving space 25 to provide sunshade effect. The sunshade sheet 3 can stretch and locate the transverse double-layered blind sheet 2 (as shown in FIG. 6).

Figure 7:
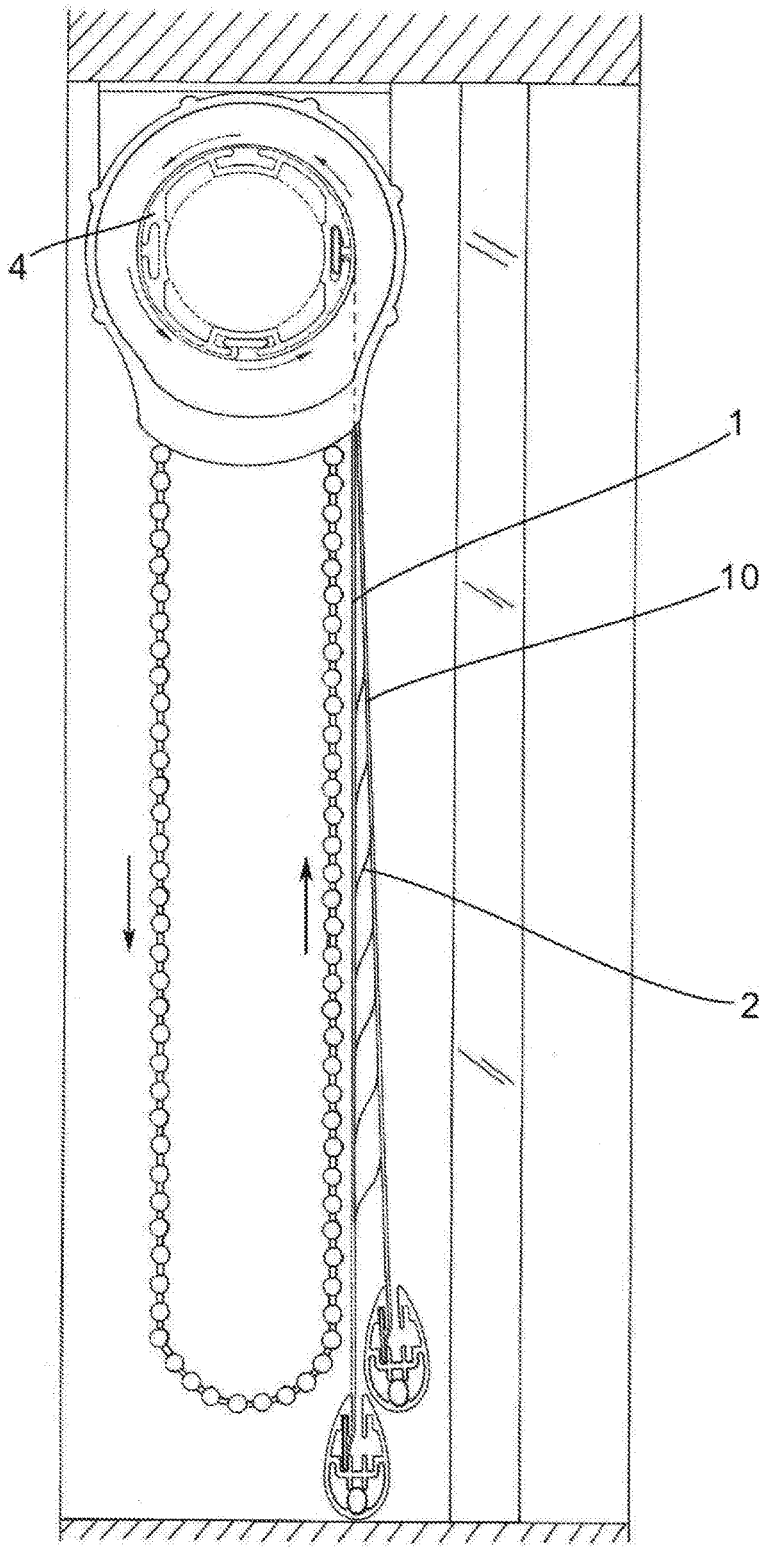
FIG. 7 is a view of the transverse double-layered blind sheet of the present invention, showing the operation thereof.
Figure 8:
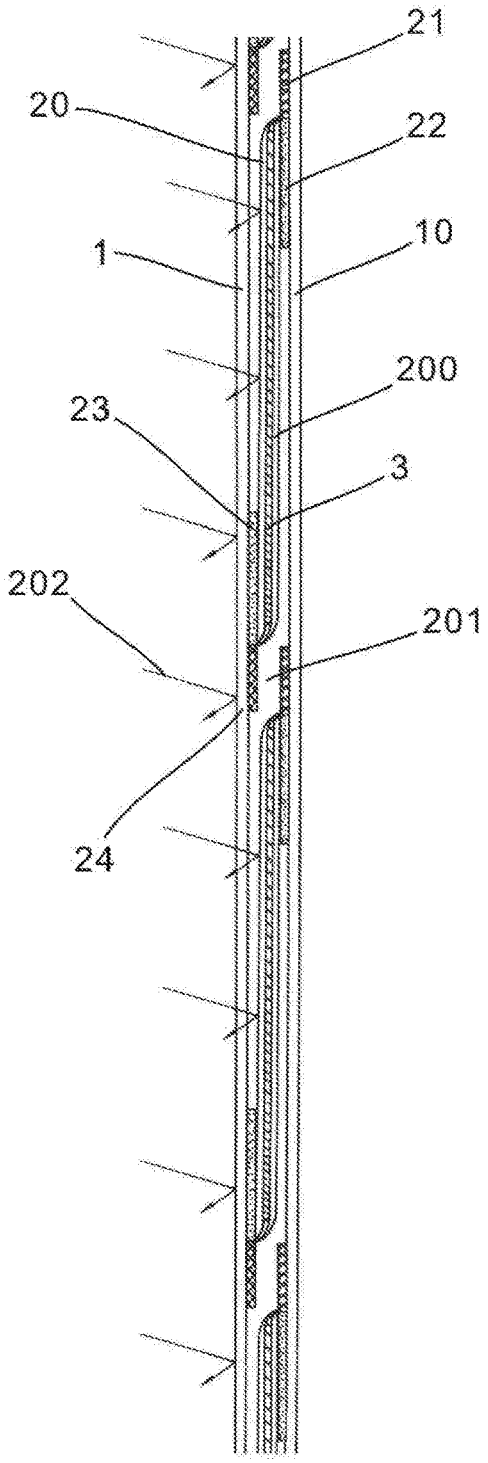
FIG. 8 is a view of the transverse double-layered blind sheet of the present invention, showing that the transverse double-layered blind sheet shades the sunlight.

When shading the sunlight, a reel 4 is operated to move the first and second blind sheets 1, 10 to one side and attach the first and second blind sheets 1, 10 to each other. At this time, the upper and lower yarn sheets 20, 200 of the transverse double-layered blind sheet 2 get closer to each other and the sunshade sections 21, 22, 23, 24 upward and downward extending along the sown positions overlap each other (as shown in FIGS. 7 and 8). In this case, the gap 201 between the upper and lower yarn sheets 20, 200 is blocked so that the sunlight 202 cannot be projected into the room. The present invention can achieve the same sunshade effect no matter whether the blind sheets are wound clockwise or counterclockwise.

Figure 9:
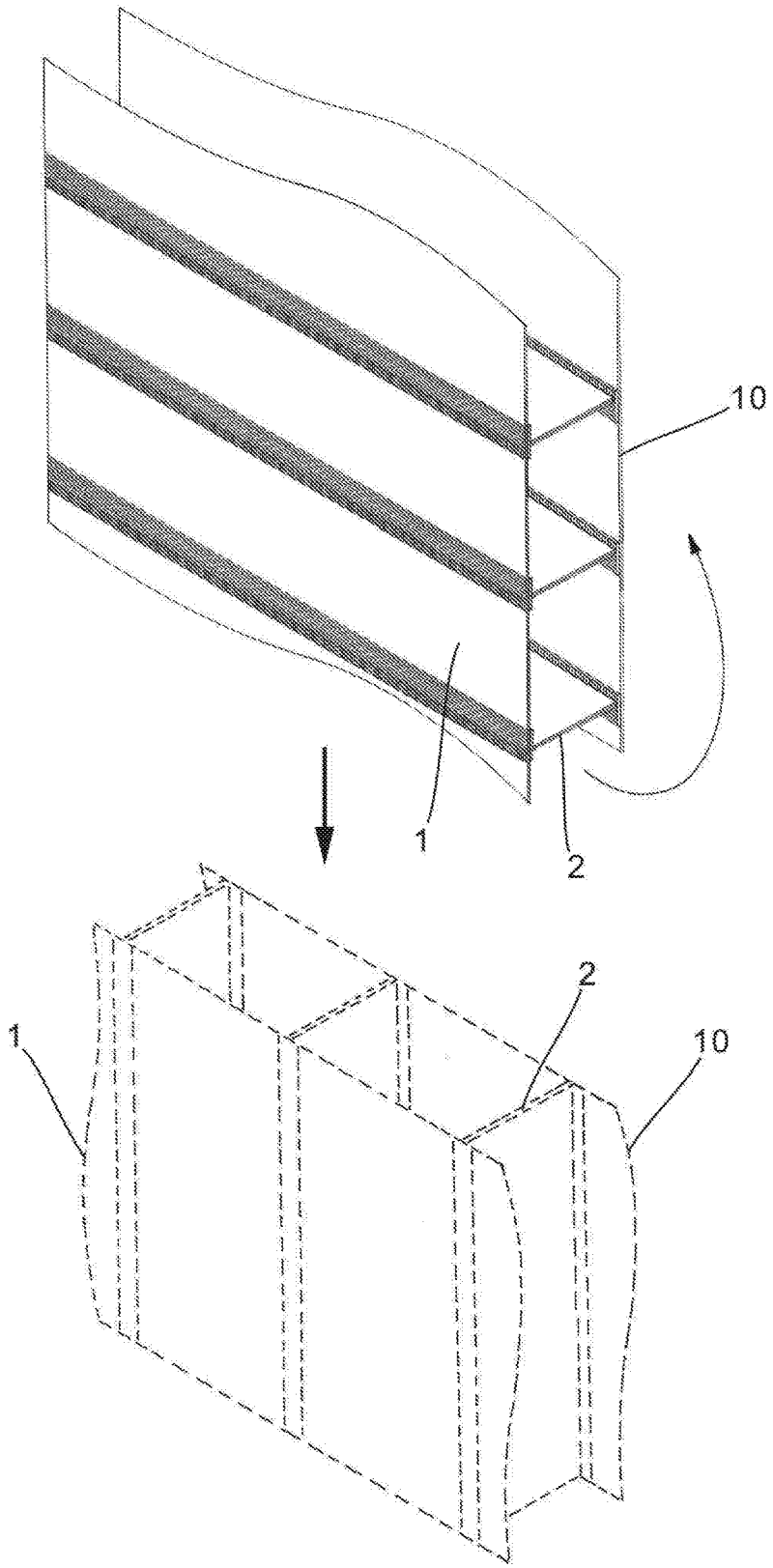
FIG. 9 is a view showing that the present invention is turned.
Figure 10:
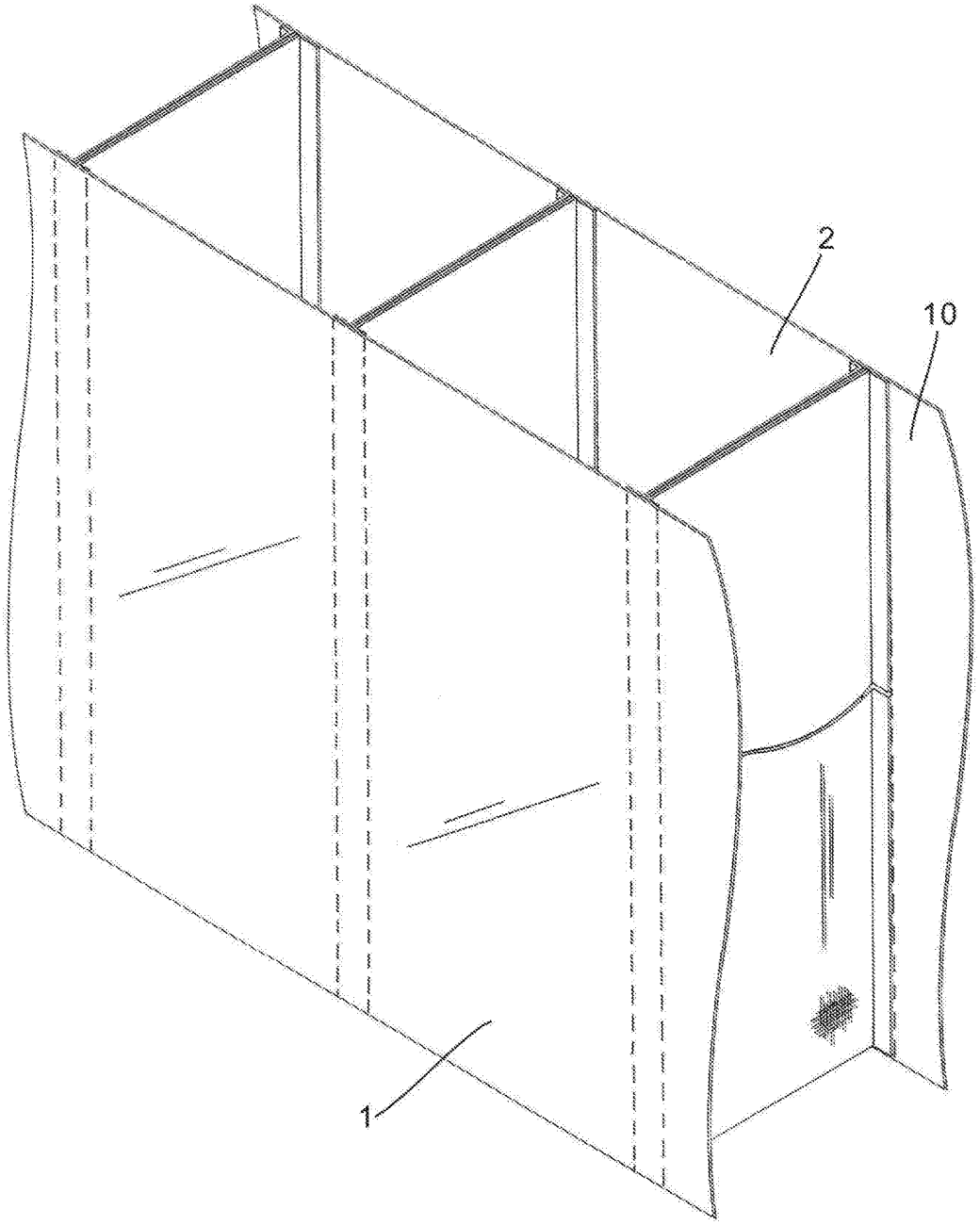
FIG. 10 is a perspective view of the present invention used as a vertical blind.

When the present invention is used as a vertical blind (as shown in FIG. 9), the first and second blind sheets 1, 10 in a vertical state are directly 90-degree turned. At this time, the transverse double-layered blind sheet 2 originally in a transverse state is turned into a vertical state (as shown in FIG. 10). Then, a fixing plate assembly 5 is secured to the top end of the transverse double-layered blind sheet 2 so as to cooperatively hang the transverse double-layered blind sheet 2 on a slide box 7. At this time, the present invention can be used as a vertical blind.

Figure 11:
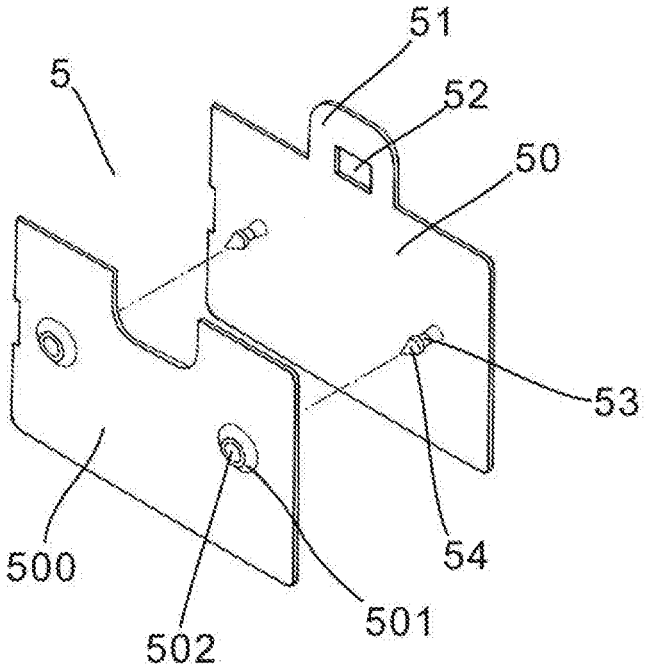
FIG. 11 is a perspective exploded view of the fixing plate assembly of the present invention.
Figure 12:
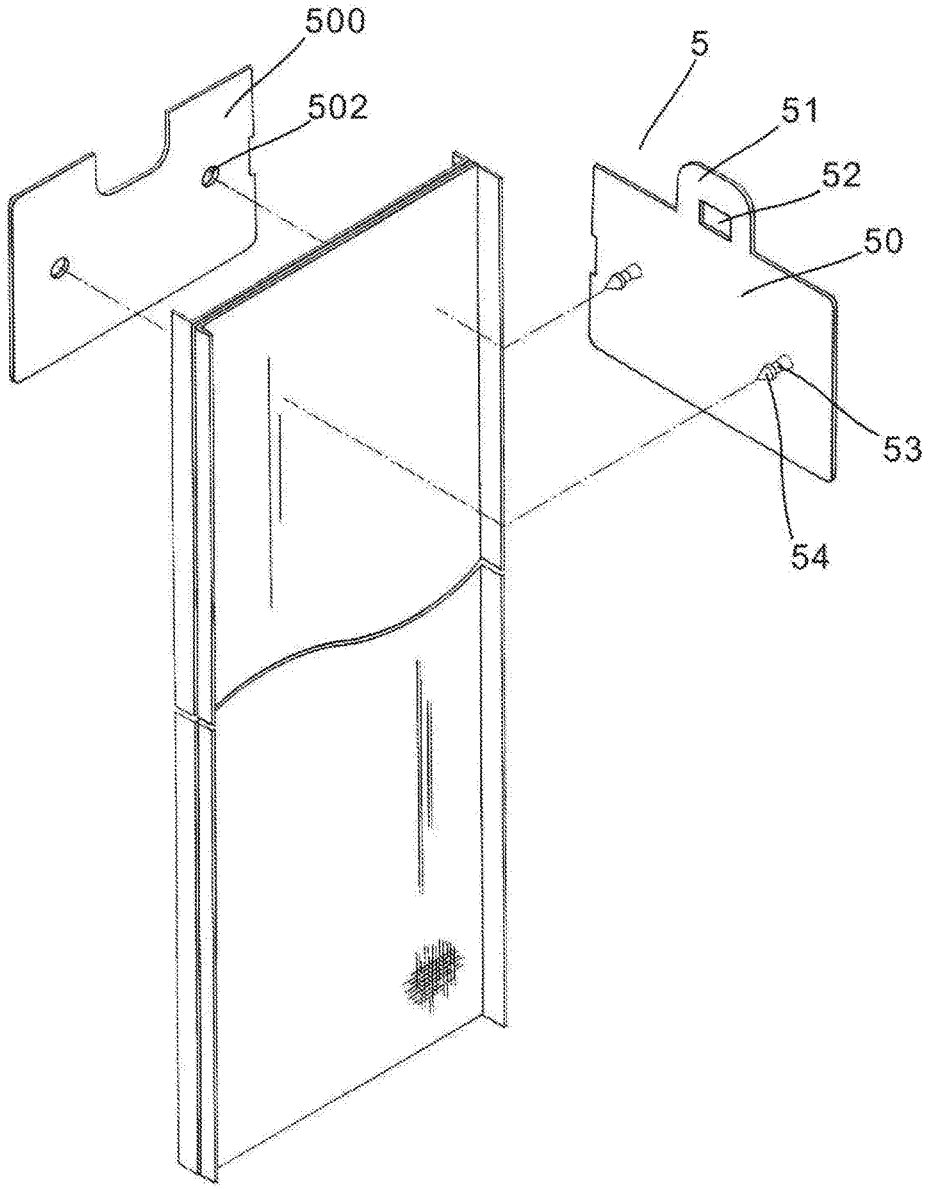
FIG. 12 is a perspective view showing the installation of the fixing plate assembly of the present invention.
Figure 13:
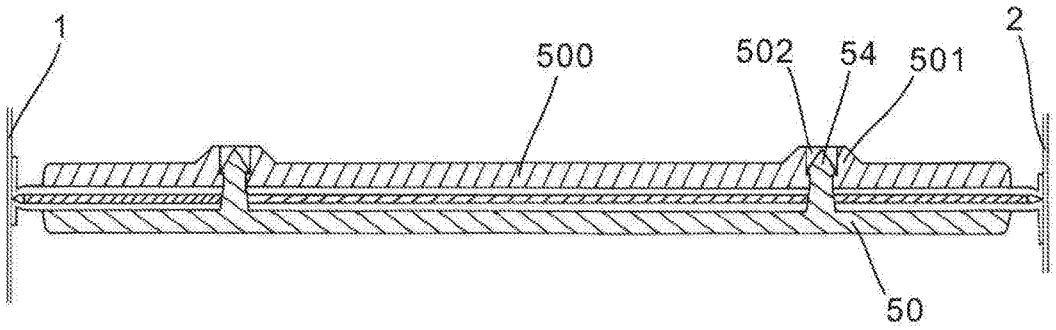
FIG. 13 is a sectional assembled view of the fixing plate assembly of the present invention.
Figure 14:
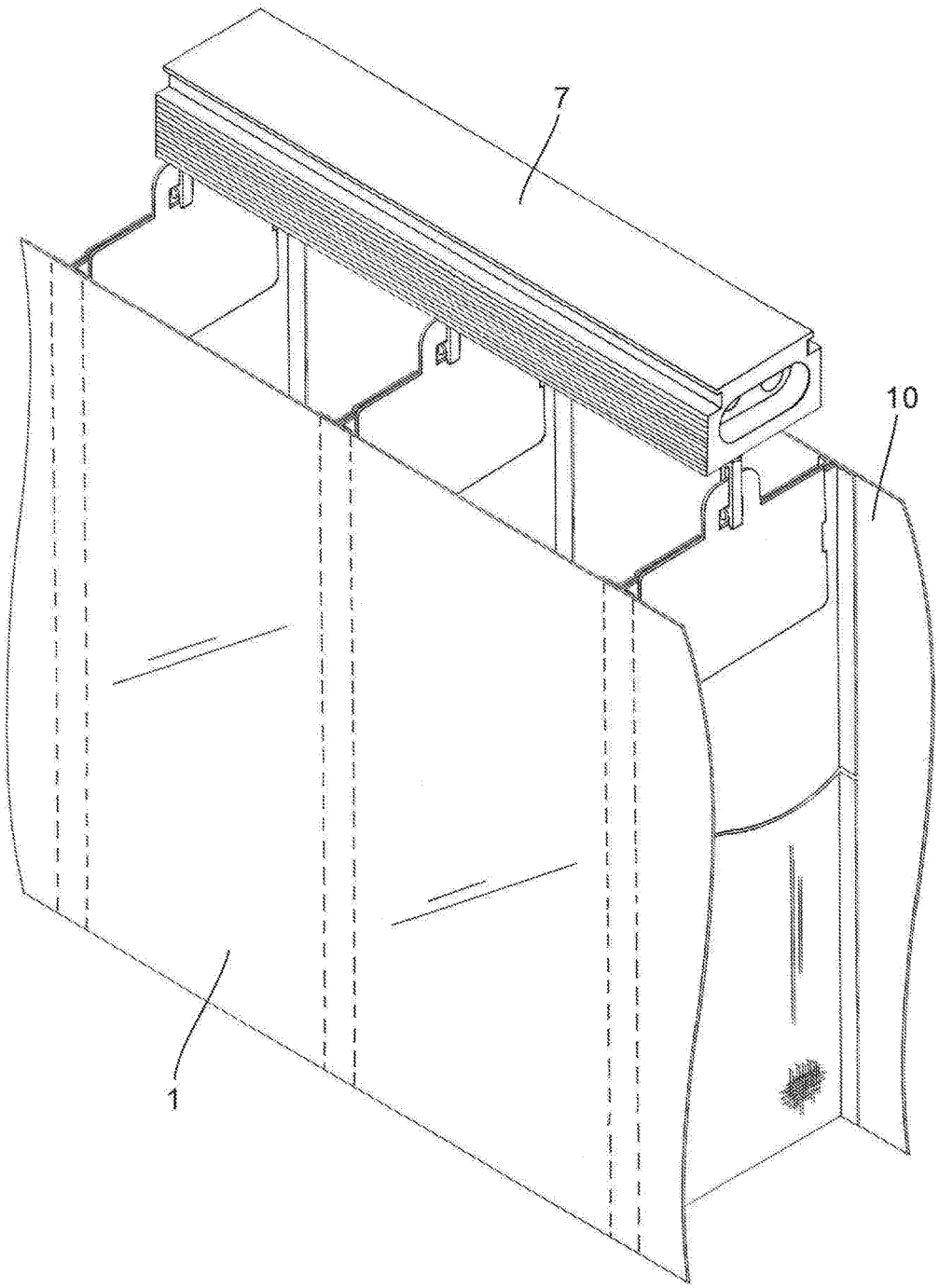
FIG. 14 is a perspective view showing that the present invention is used as a vertical blind hung on the hanging rod of the slide box.

The fixing plate assembly 5 (as shown in FIG. 11) includes a plate-shaped main body 50 and a connection plate 500 correspondingly assembled with the main body 50. A protrusion plate 51 extends from upper edge of the main body 50. The protrusion plate 51 is formed with a hanging hole 52 for hanging on a hanging rod of the slide box. More than one fixing posts 53 protrude from two sides of an inner face of the main body 50. A sharp conic section 54 is formed at the front end of each fixing post 53 for penetrating the blind sheets. The connection plate 500 for correspondingly assembling with the main body 50 has an area in conformity to that of the main body 50 of the fixing plate assembly 5. In addition, the mating face of the connection plate 500 is formed with engagement sections 501 for the fixing posts 53 to insert therein. Each engagement section 501 is formed with a longitudinal engagement perforation 502. Accordingly, the fixing posts 53 can be engaged and assembled with the engagement perforations 502 to connect the fixing plate assembly 5 with the transverse double-layered blind sheet 2 (as shown in FIGS. 12, 13 and 14).

Figure 15:
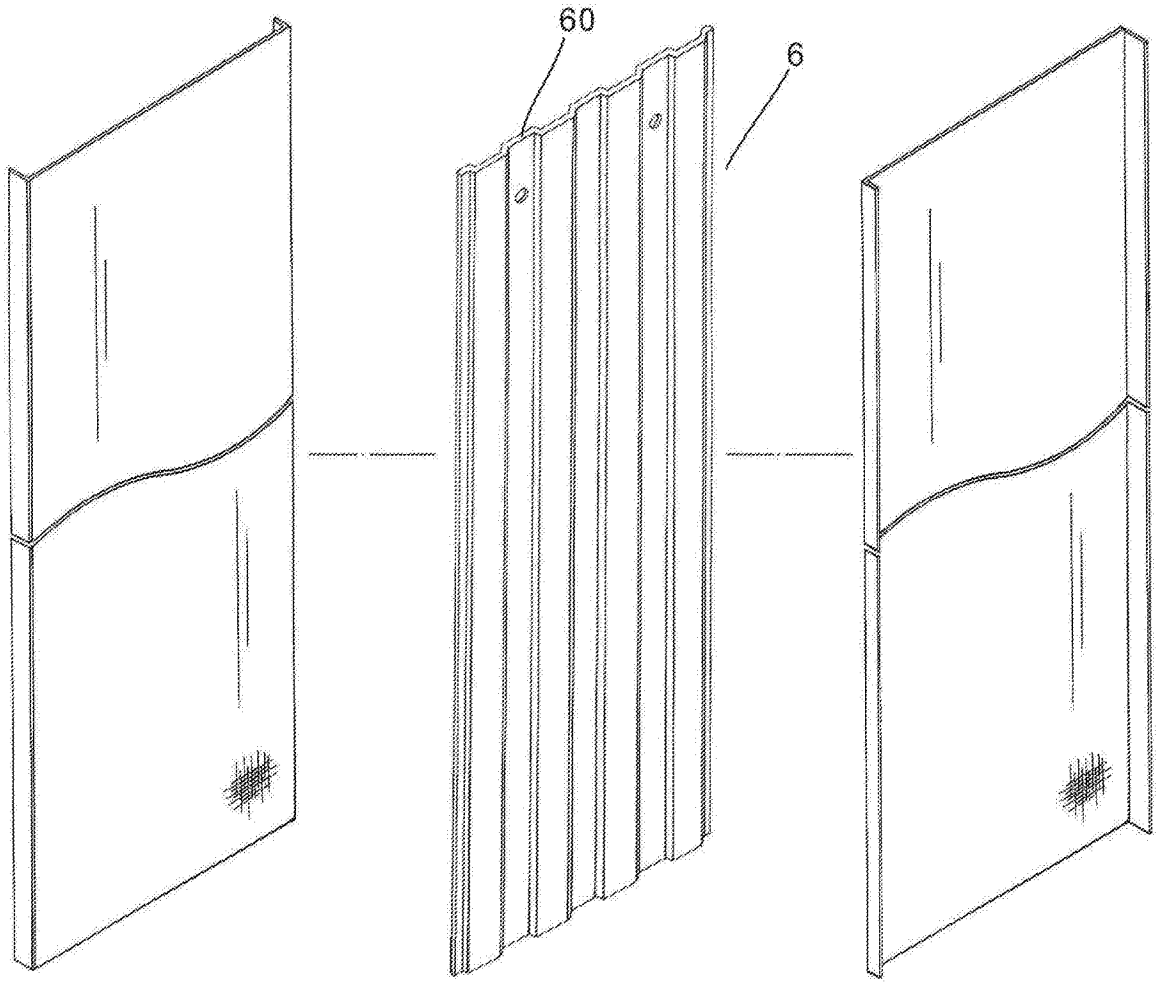
FIG. 15 is a view of another embodiment of the sunshade sheet of the present invention.
Figure 16:
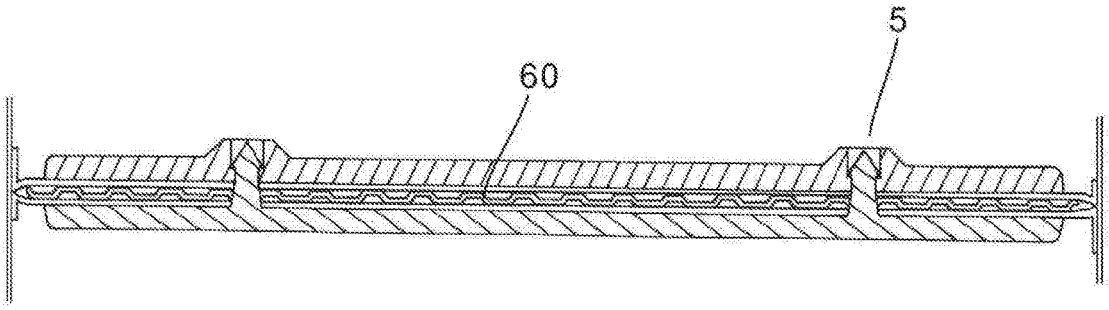
FIG. 16 is a sectional assembled view of the other embodiment of the sunshade sheet of the present invention.

Please now refer to FIGS. 15 and 16. In another embodiment of the present invention, the sunshade sheet 6 is waved to form a non-plane wave configuration 60. In this case, the strength of the sunshade sheet 6 is enhanced. The sunshade sheet 6 is sandwiched between the upper and lower yarn sheets 20, 200 of the transverse double-layered blind sheet 2. Then, the fixing plate assembly 5 is secured to the transverse double-layered blind sheet 2. By means of controlling and rotating the reel 4, the blind sheets can be easily adjusted to provide better sunshade effect.

In conclusion, according to the technical means of the present invention, the sunshade sections of two sides of the transverse double-layered blind sheet upward and downward extend along the sown positions and can overlap each other to block the gap between the upper and lower yarn sheets so as to enhance the sunshade effect. Moreover, the present invention is convertible between two use modes, that is, vertical blind and Shangri-la blind. The present invention is dual-usable so that the cost is saved and the application range is widened. Therefore, the present invention is highly competitive.

The above embodiments are only used to illustrate the present invention, not intended to limit the scope thereof. Many modifications of the above embodiments can be made without departing from the spirit of the present invention.

What is claimed is:

1. A blind co-used sheet convertible between two use modes of vertical blind and Shangri-la blind, the blind co-used sheet comprising a vertical first blind sheet, a vertical second blind sheet and transverse double-layered blind sheets sewn between the first and second blind sheets, each transverse double-layered blind sheet including an upper yarn sheet and a lower yarn sheet, two lateral sides of the upper and lower yarn sheets being respectively sewn on the first and second blind sheets, whereby different areas of sunshade sections upward and downward extend along the sewn positions, after the upper and lower yarn sheets of the transverse double-layered blind sheet are sewn, a receiving space being formed between the upper and lower yarn sheets, a nontransparent flexible sunshade sheet being placed in the receiving space to provide sunshade effect, whereby the blind co-used sheet is used as a Shangri-la blind, a fixing plate assembly being additionally disposed at front ends of the upper and lower yarn sheets and the flexible sunshade sheet, whereby the Shangri-la blind can be 90-degree turned along with the fixing plate assembly to convert the first and second blind sheets from a vertical state into a horizontal state and the transverse double-layered blind sheet into a vertical state, whereby the blind co-used sheet is used as a vertical blind so that the blind co-used sheet is convertible between the vertical blind and the Shangri-la blind.

2. The blind co-used sheet as claimed in claim 1, wherein the fixing plate assembly includes a plate-shaped main body and a connection plate correspondingly connected with the main body, a protrusion plate extending from upper edge of the main body, the protrusion plate being formed with a hanging hole, several fixing posts protruding from an inner face of the main body, a mating face of the connection plate being formed with engagement sections corresponding to the fixing posts, whereby the fixing posts can be engaged with the engagement sections.

3. The blind co-used sheet as claimed in claim 2, wherein a sharp conic section is formed at a front end of each fixing post of the fixing plate assembly that protrudes from the inner face of the main body.

4. The blind co-used sheet as claimed in claim 1, wherein the transverse double-layered blind sheet is sewn on the first and second blind sheets in a non-horizontal oblique state.

5. The blind co-used sheet as claimed in claim 1, wherein the nontransparent flexible sunshade sheet is a waved sheet with a non-plane cross section.

* * * * *